United States Patent [19]

Pate

[11] Patent Number: 4,941,664

[45] Date of Patent: Jul. 17, 1990

[54] GOLF SHOT DUPLICATOR

[76] Inventor: Dwight W. Pate, 101 Mirada Rd., Half Moon Bay, Calif. 94019

[21] Appl. No.: 302,926

[22] Filed: Jan. 30, 1989

[51] Int. Cl.[5] ..... A63B 69/36; A63B 67/02

[52] U.S. Cl. ..... 273/35 B; 273/176 A; 273/195 R

[58] Field of Search ..... 273/176 A, 176 R, 176 AB, 273/35 B, 35 R, 195 R, 195 A, 196, 183 A, 176 B, 176 K, 176 L, 195 B

[56] References Cited

U.S. PATENT DOCUMENTS

| | | | |
|---|---|---|---|
| 1,761,317 | 6/1930 | Strasser | 273/176 |
| 1,851,423 | 3/1932 | Ely . | |
| 2,003,074 | 5/1935 | Gage | 273/32 |
| 2,195,634 | 4/1940 | Shelly, Jr. | 273/32 |
| 2,482,210 | 9/1949 | Reach, Sr. et al. | 273/32 |
| 3,129,943 | 4/1964 | McKee | 273/176 |
| 3,310,310 | 3/1967 | McKee | 273/176 |
| 3,464,703 | 9/1969 | Vallas | 273/176 |
| 3,599,980 | 8/1971 | Harmond | 273/176 A |
| 3,649,027 | 3/1972 | Vallas | 273/176 A |
| 3,685,832 | 8/1972 | Johnson | 273/176 A |
| 3,719,361 | 3/1973 | Rotolo | 273/176 AB |
| 3,904,209 | 9/1975 | Thomas | 273/176 A |
| 3,999,764 | 12/1976 | Nitsche | 273/176 AB |
| 4,063,738 | 12/1977 | Michalson | 273/176 A |
| 4,129,300 | 12/1978 | Magnuson | 273/176 A |
| 4,331,332 | 5/1982 | Hughes | 273/195 B |
| 4,395,042 | 7/1983 | Boswell | 273/176 B |

OTHER PUBLICATIONS

Architect's plan for Golf Center, 1988.

*Primary Examiner*—George J. Marlo
*Attorney, Agent, or Firm*—A. C. Smith

[57] ABSTRACT

A golf duplicator course and game method includes large putting greens on which putting is performed and target areas associated with tees on a teeing loop, from which loop all other shots are performed. The teeing loop has surfaces of tall grass, short grass, sand and hardpan at various elevations and degrees of level, up-, down-, and side-sloping terrain.

2 Claims, 5 Drawing Sheets

GOLF SHOT DUPLICATOR

BACKGROUND AND FIELD OF THE INVENTION

The present invention relates generally to a recreational game somewhat similar to golf which uses typical golf equipment but uses different rules and is played on a course unlike a standard golf course.

The game of golf, though extremely popular in the United States and elsewhere, suffers from a number of inherent disadvantages. Traditional golf course layouts require large amounts of vacant land, thus making it both expensive and difficult to create courses in many areas of the country, especially in urban areas. Because so much land is required, maintenance costs for traditional courses are correspondingly high. These costs are passed on to golfers in the form of high, sometimes exorbitant, playing fees which tend to discourage beginners and those of moderate means from enjoying the game.

Another element of standard golf that frustrates its popularity is the amount of time it takes to play a game, especially during busy periods. Although some might consider a four or five hour golf game enjoyable, most others simply cannot or will not often spare the time typically required to complete a round of golf. In addition, standard golf course layouts produce "bottlenecks" of player activity during peak periods such as weekends, and players are often forced to wait for long periods to tee off on certain holes. Despite these difficulties, it is commonly predicted that demand for golf facilities in the next decade will significantly exceed the supply of courses presently available, under construction, or foreseen.

It is therefore an object of the present invention to provide a game that includes the benefits but obviates these deficiencies of standard golf. More specifically, it is an object of the present invention to provide a golf-like game that requires use of significantly less land area. It is another object of the present invention to provide a golf-like game that requires less time to play while maintaining the same level of involvement (average number of shots). It is still another object of this invention to enhance the popularity of golf by the reduced cost and added convenience to players provided by the invention.

SUMMARY OF THE INVENTION

In accordance with the invention, a playing course is provided with a plurality of target areas and a teeing loop. A plurality of large putting green areas are also provided.

Preferably, the teeing loop is divided into several sections, each of which may be subdivided into smaller subsections, or teeing locations. Different "lies" may be landscaped onto the teeing loop to duplicate various "lies of the ball" which occur in standard golf.

There are two phases of play in the game of the present invention. In the first, or "loop" phase, the objective is to stroke a golf ball, using standard golf clubs, from each subsection or "tee" of the teeing loop toward the corresponding target area for that subsection. If the ball comes to rest within the target area, the player's score is incremented by one and the player moves on to the next tee. If the ball does not come to rest within the target area, the player tries again from the same teeing location. If this next ball comes to rest within the target area, the player's score is incremented by two; otherwise the player's score is incremented by three, which is the highest possible score from any teeing location. After the second ball is hit from a teeing location, the player must move on to the next tee of the teeing loop. The scoring scheme may alternatively be set up to allow only one stroke from each teeing location, with the player's score being incremented by one or two depending upon whether the ball does or does not come to rest within the target area, respectively. Each tee of the teeing loop is assigned a particular target area, toward which the player should aim his shot. Preferably, target areas for short shots are generally circular in shape encircling a target flag to duplicate a standard golf green, while target areas for longer shots are more rectangular in shape and duplicate fairways which one might aim for in a game of standard golf.

After the player has taken a number of shots from various subsections of the teeing loop, the second or putting phase of the game may begin. This phase is played on any of several large putting greens located outside of the teeing loop area. The game may be set up so that all shots in the loop phase are completed before the putting phase begins, or players may be directed to shift from the loop phase to the putting phase, and then back again, after any number of designated shots. In the putting phase, the player putts the specified number of holes in a designated sequence on one or more of the large putting greens, the player's score being incremented by one for each shot taken, as in standard golf. The player's final score, then, is the total of the scores from the two phases of the game. Preferably, the course is laid out so that this score may approximate the player's score in standard play on a regulation course.

DETAILED DESCRIPTION OF A PREFERRED EMBODIMENT

Figure 1:
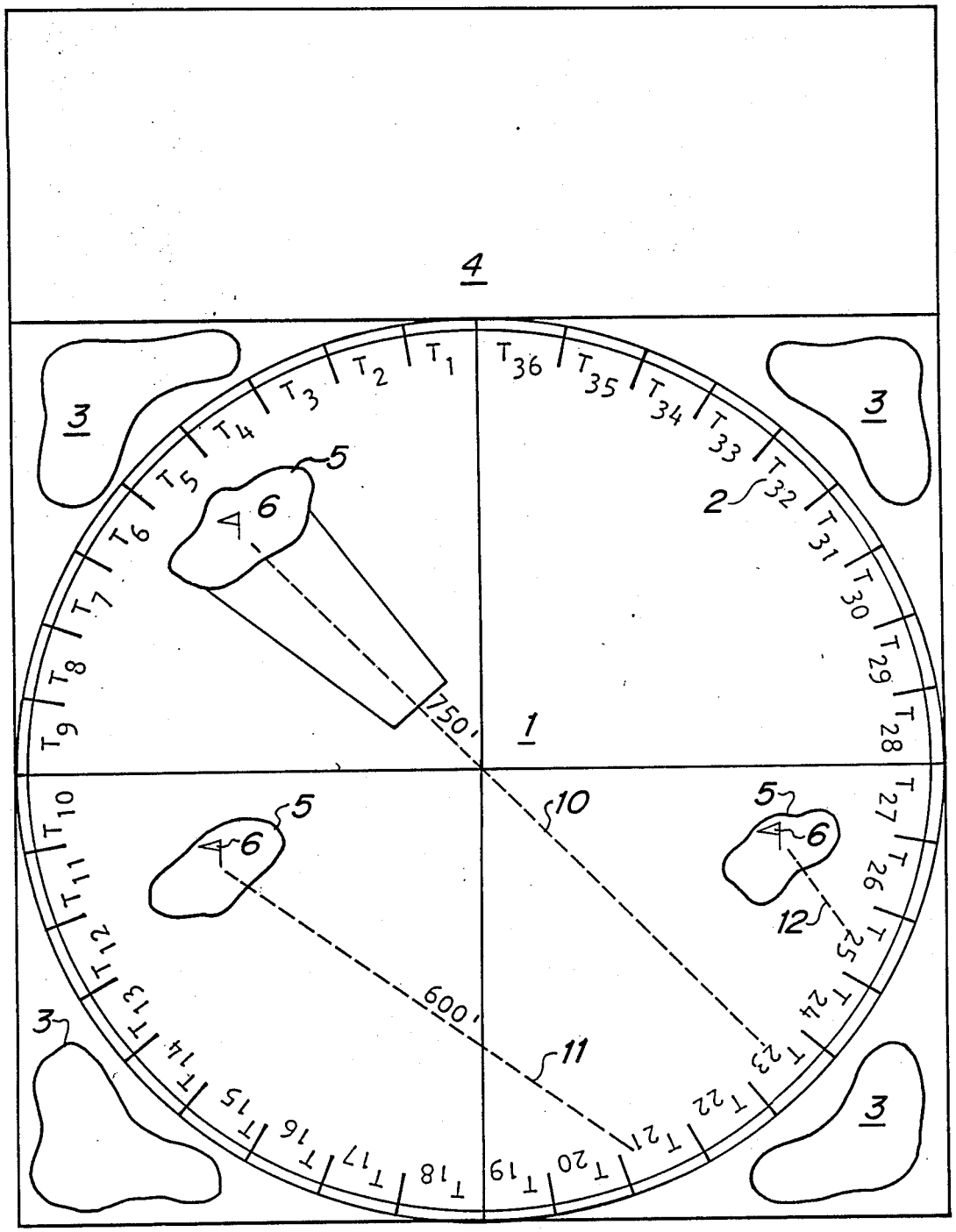
FIG. 1 is an overhead view of one basic layout for a playing course according to the present invention.
Figure 2:
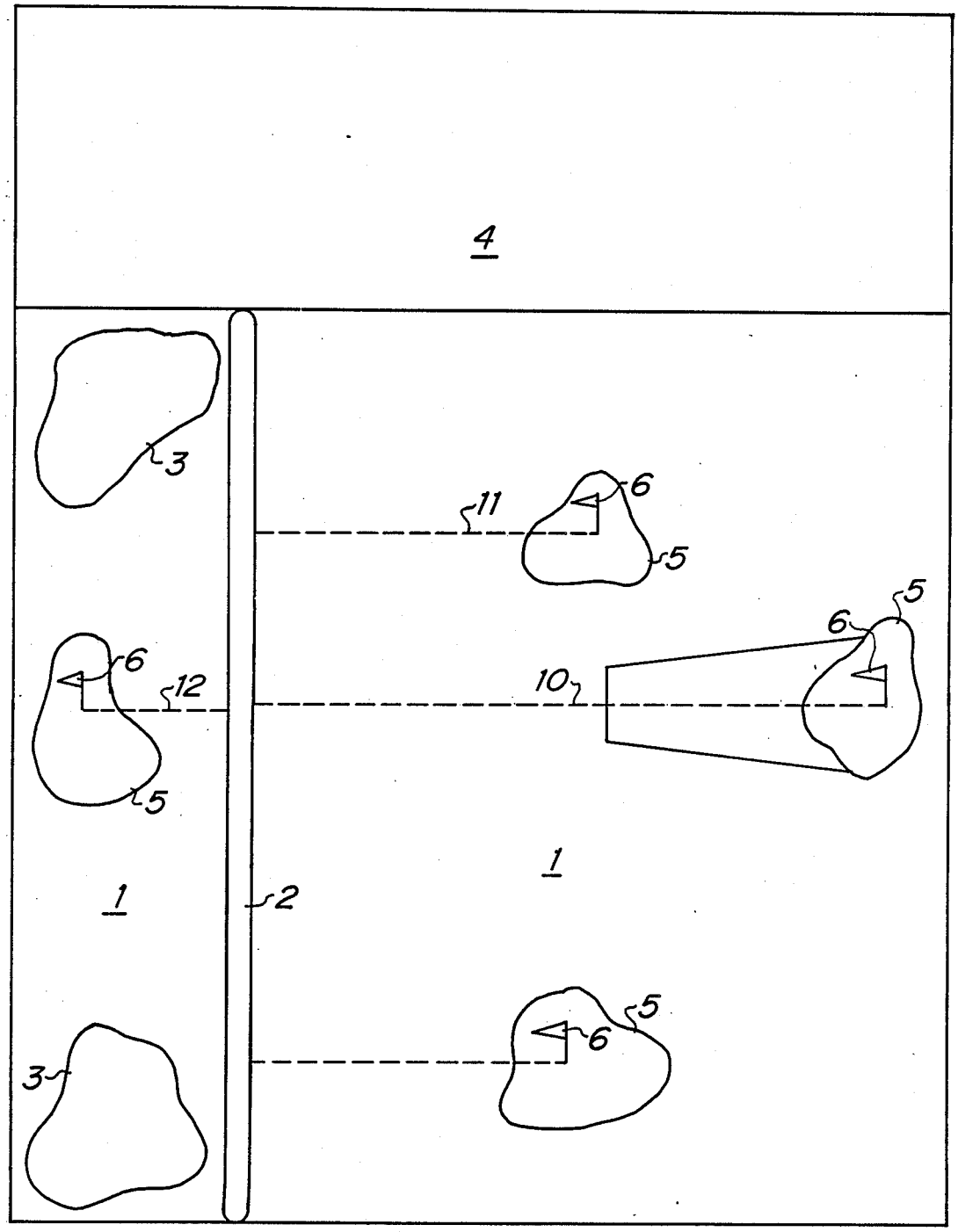
FIG. 2 is an overhead view of another possible layout for a playing course according to the present invention.
Figure 3:
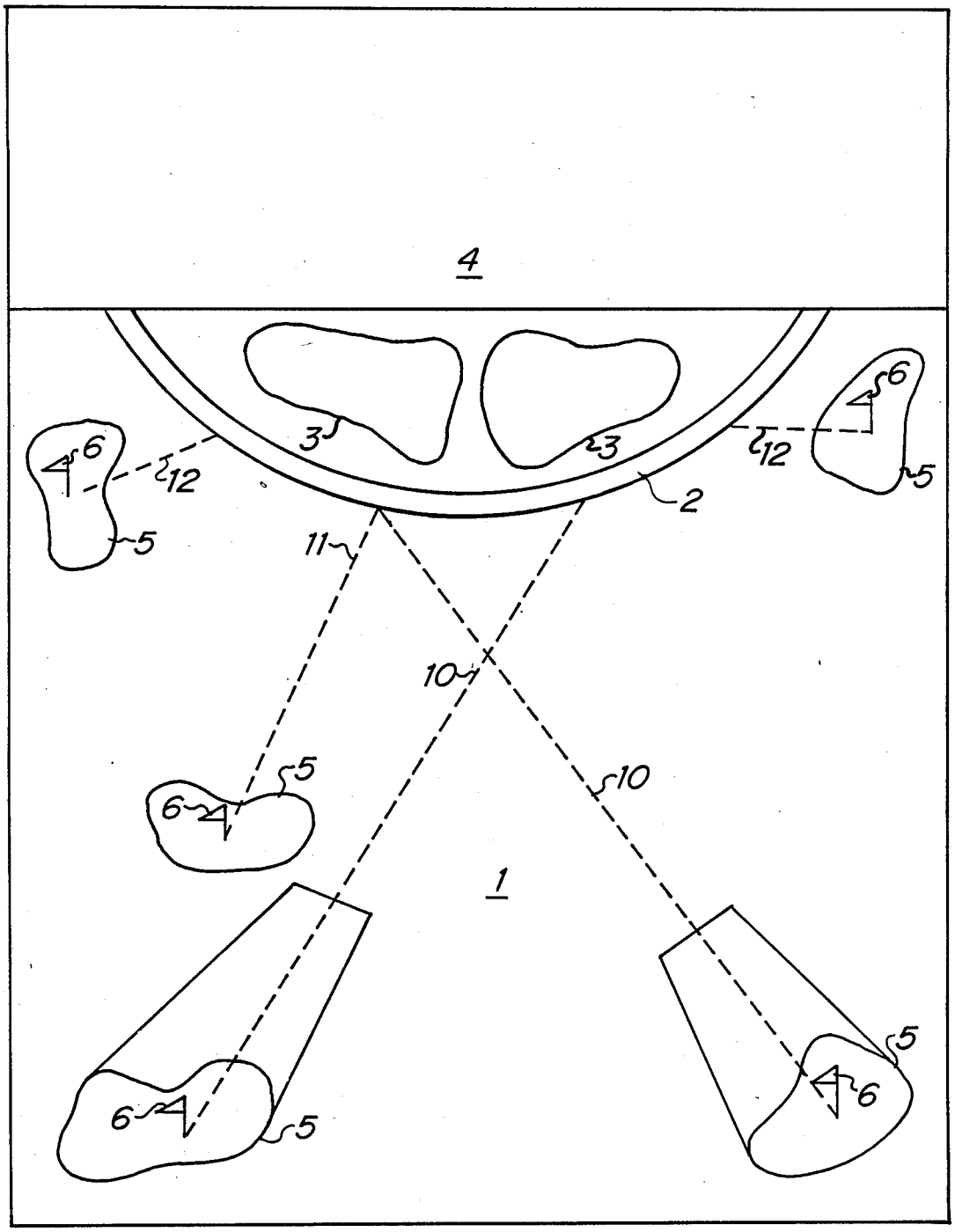
FIG. 3 is an overhead view of a third possible layout for a playing course according to the present invention.

Referring now to FIG. 1, there is shown a preferred embodiment of the playing course for the proposed invention, including an inner area 1, within which the plurality of target greens and fairways 5 and target flags 6 are located. Surrounding the inner area 1 is the teeing loop 2 which is subdivided into a plurality of subsections or teeing locations that are designated T1 to T36. The embodiment shown in FIG. 1 employs a generally circular teeing loop 2 with nine subsections in each quadrant for a total of 36 subsections, but any shape loop (including elliptical, irregular and broken loops) may also be used, with any number of subsections in a teeing loop. For example, FIG. 2 shows a second preferred embodiment employing a linear, rather than circular teeing loop 2. FIG. 3 shows a third preferred embodiment employing a teeing loop 2 in the shape of an open arc. The longest shots for the course are generally along diametrical lines 10, with intermediate and shorter shots oriented in other directions.

Referring again to FIG. 1, outside of the teeing loop 2 are a plurality of large putting greens 3, each of which is provided with a plurality of holes. The embodiment shown in FIG. 1 includes four greens, but any number of greens may be included, as space allows. For instance, the embodiments shown in FIGS. 2 and 3 employ two putting greens. Adjacent to the playing course is an area 4 for commercial buildings and parking as may be required.

Figure 4A:
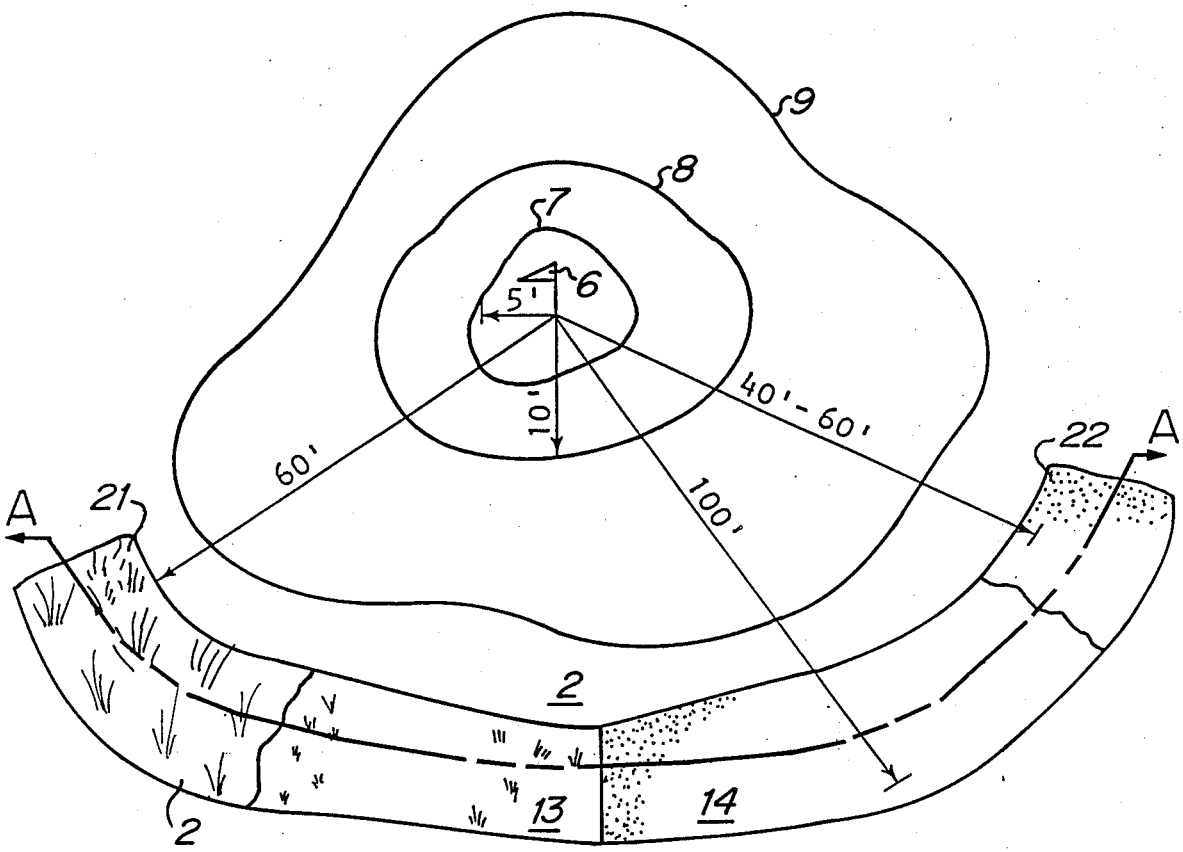
FIGS. 4*a* and 4*b* , respectively are an overhead view and a cutaway-perspective of one possible subsection of the teeing loop and its corresponding target area according to the present invention.
Figure 4:
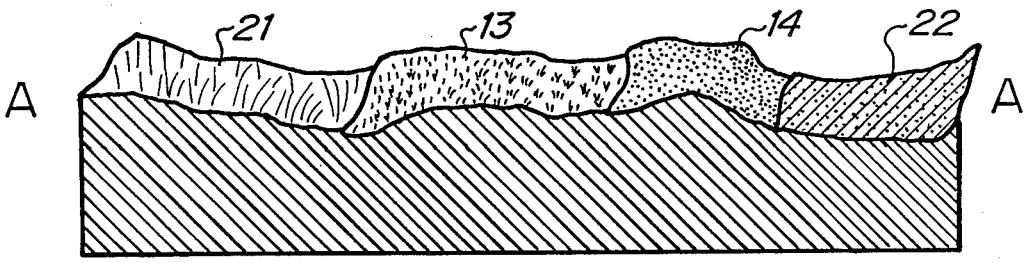

FIGS. 4*a* and 4*b* illustrate one example of a target area for relatively short shots, such as chip, pitch and sand shots. The target flag 6 in this case is surrounded by different lines to provide multiple target areas for differing levels of player ability. The smallest area within line 7 is the target area that players with the highest levels of skill might be directed or choose to use. The outer lines 8, 9 surround target areas of progressively larger areas that players of lesser ability might be directed or choose to use. The actual sizes, shapes and locations of the different target areas may vary in accordance with available land area and landscaping in order to segregate subsections of the teeing loop and associated target areas from other subsections of the teeing loop and associated target areas. FIG. 4 also illustrates the different "lies" that may exist within the teeing loop. Players may, for instance, be directed to shoot for the target first from a grassy "lie" 13 or 21 and next from a "lie" duplicating a sandtrap 14. Variations in surface including tall grass 21 or short grass 13, soft sand 14 or "hardpan" 22, and the like may be included in subsections around the teeing loop 2 at various elevations and degrees of level, up-, down- or side-sloping terrain as shown in the cutaway-perspective view A—A of FIG. 4*a*.

Figure 5:
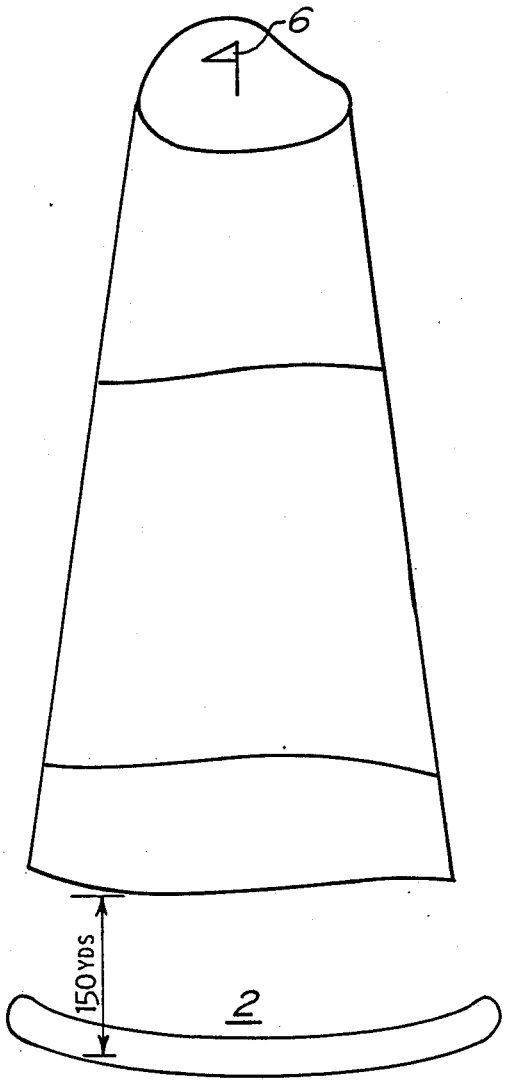
FIG. 5 is an overhead view of another possible subsection of the teeing loop and its corresponding target area according to the present invention.

FIG. 5 illustrates one target area layout according to the present invention for a long "driver" shot. In this example, the target areas lie between the teeing loop 2 and the target flag 6 in a configuration that may include landscaping to impose fairway-like space limitations and to discourage shots beyond the target flag 6.

The course according to the present invention may be implemented on areas of land on the order of 20 or more acres which are significantly smaller than the area required for standard golf courses, and more conducive to construction on landfill and land reclamation areas and in urban and other areas where prohibitive land and maintenance costs preclude construction and operation of standard golf courses.

Standard golf equipment is used to play the game according to the present invention. The game is played by rules which differ significantly from the rules of standard golf although the objective of the game is to complete the game in the minimum number of strokes. However, unlike standard golf, the course according to the present invention is not completed by stroking (or "shooting" or "driving") a ball from each tee to each hole sequentially. Rather, the game of the present invention is played in two phases, and only in the second, or putting phase, is it desirable to stroke the ball into a target hole. In the first, or "loop" phase of the game, the player's objective is to stroke the ball to anywhere within a designated target area. In this phase, once a ball is stroked from the teeing loop, it is never played again. If the ball comes to rest in the target area, the player's score is incremented by one and the player moves on to the next tee to take his next shot. If the player's first shot does not come to rest in the target area, the player tries once more from the same spot on the teeing loop. Depending upon whether that second shot is successful, the player's score is incremented by one or two, and the player moves on to the next tee to make the next shot. An alternative, faster method of play does not allow this second shot but merely increments the player's score by one or two, depending upon whether the first shot was successful. As a result, no significant amount of time is consumed walking from location to location for successive shots as in standard golf. In standard golf, the distance golfers must walk between shots is often on the order of hundreds of yards, and golf parties may be split up if the players' balls go in different directions. In the game provided by this invention, players need only walk a few yards to the next tee for the next shot, and they remain together regardless of where previous shots have landed. Also, the course of the present invention obviates the need to find balls which are hit poorly, since the players use a supply of balls provided by the course operator which never have to be retrieved.

Play during the first phase commences from any of the plurality of teeing loop subsections, and progresses from one subsection of the teeing loop to the next through a few or all of the subsections of the teeing loop, as desired or directed. The sequence of play may interchange the two phases of the game, or play may be set up for each phase to be completed in turn. In the former situation, the course is set up in such a way that players are directed back and forth from the teeing loop 2 to a plurality of putting greens 3 until they have completed both phases. In the latter situation a player completes one phase before playing the other. For the second or putting phase the player may choose or be directed to one of the plurality of large putting greens 3 on which to play. Each putting green 3 includes a plurality of holes, or "cups", of the type used on a standard golf course. In one possible embodiment each green includes eighteen such cups. Alternatively, any number of cups may be distributed among the plurality of putting greens 3. Play on these greens differs from traditional golf in that putts for each hole are played in direct sequence, without the need for longer shots in order to reach the green for each successive hole. In one possible embodiment, a plurality of markers are included on each green to mark where putting for a specific cup should begin. The player strokes the ball from these marks towards the cup, increasing the player's score by one for each stroke taken until the ball drops into the cup. Then, the ball is removed from the cup, placed behind the marker associated with the next cup, and putting continues. Once the shots of both phases have been completed, the game is over. Each player adds up the scores from both phases, and the player with the lowest score wins the game.

One advantage which may accrue from the invention, depending upon the embodiment chosen, is that the need for players who are "teed up" to wait for the course to be clear before shooting will be obviated, since players may never actually enter the areas 1 toward which shots from the teeing loop are being made. Also, the reduced amount of walking and the elimination of searching for balls dramatically reduces playing time to the order of approximately one hour instead of the four to five hours typically required to play a round of golf on a standard course.

Other embodiments of the present invention may depart from the teeing loop configuration illustrated in FIGS. 1, 2 and 3, and, as with standard golf courses, each course may differ in configuration from other courses.

I claim:

1. A course for duplicating golf shots comprising:

a target area including a plurality of targets at spaced locations therein; and a teeing loop disposed substantially about said target area, the teeing loop including a plurality of teeing locations at spaced apart positions therealong for playing selected ones of said plurality of targets, said teeing location having golf balls teeing surfaces including tall grass, short grass, sand and hardpan dirt, with such surfaces disposed at various elevations and degrees of level, up-sloping, down-sloping side-sloping terrain.

2. A course as in claim 1 comprising a plurality of target areas for each teeing location to correspond to differing levels of player ability.

* * * * *